US005114788A

United States Patent [19]

Nakagawa et al.

[11] Patent Number: 5,114,788

[45] Date of Patent: May 19, 1992

[54] FABRIC HAVING WATER ABSORPTION PROPERTY AND METHOD OF MANUFACTURING THE FABRIC

[75] Inventors: Yukio Nakagawa, Katano; Syoji Koizumi, Izumi; Masao Miyake, Otsu; Teruo Akita, Kusatsu; Tomohisa Uno, Koga, all of Japan

[73] Assignee: Asahi Kasei Textile Ltd., Tokyo, Japan

[21] Appl. No.: 421,109

[22] Filed: Oct. 13, 1989

[30] Foreign Application Priority Data

Oct. 17, 1988 [JP] Japan ..... 63-259409
Apr. 28, 1989 [JP] Japan ..... 1-109959

[51] Int. Cl.[5] ..... B32B 27/00; B32B 9/00

[52] U.S. Cl. ..... 428/284; 428/286; 428/289; 428/290; 428/304.4

[58] Field of Search ..... 428/165, 297, 284, 286, 428/289, 290, 304.4

[56] References Cited

U.S. PATENT DOCUMENTS 3,304,194 2/1967 Dabrowski ..... 428/165
4,543,410 9/1985 Cruz, Jr. ..... 428/297

*Primary Examiner*—William J. Van Balen
*Attorney, Agent, or Firm*—Finnegan, Henderson, Farabow, Garrett & Dunner

[57] ABSTRACT

A fabric having a superior moisture permeability and water absorption. The superior features of the fabric in accordance with the present invention are provided by using a chitin group substance with a synthetic resin.

The fabric in accordance with the present invention can be obtained by immersing a base fabric in a synthetic resin including the chitin group substance or by coating at least a synthetic resin including the chitin group substance on the base fabric. The fabric manufactured by the latter method has a moisture condensation prevention property.

14 Claims, 1 Drawing Sheet

FABRIC HAVING WATER ABSORPTION PROPERTY AND METHOD OF MANUFACTURING THE FABRIC

BACKGROUND OF THE INVENTION

1. Field of the Invention

The present invention relates to a fabric having superior properties with regard to water absorption, diffusion of a water content, and discharge of a water content, and a method of manufacturing the fabric.

2 Description of the Related Art

In sports wear used for outdoor sports such as golf, jogging, skiing or the like, preferably rain water or the like does not penetrate the fabric to come in contact with the body of the wearer, and sweat emitted by the wearer, or a vapour thereof can be rapidly passed through the fabric to the outside thereof. Further, in the case of underwear or bedding, e.g., sheets, preferably the sweat is rapidly absorbed and discharged. A water proofness of a product is contrary to the obtaining of a desired water absorption and moisture permeability of the product. Accordingly, in an attempt to satisfy these contrary requirements, a fabric having a urethane resin layer having a plurality of fine pores or a solid urethane resin layer having a moisture permeability, applied to a surface thereof, is known, but the moisture permeability and the water absorption of the urethane resin layer are relatively poor, and when a quality of sweat generated during physical exercise exceeds a quantity of sweat able to pass through the urethane resin, or when the atmospheric temperature is low or the moisture content of the atmosphere is high, drops of sweat large enough to be seen by the naked eye are adhered to the inside of the fabric. Accordingly, the underwear is made wet by the sweat drops, which is unpleasant for the wearer.

Since a cellulose group fiber such as a cotton, a viscose rayon or the like have a superior water absorption, those fibers have been used for under wear, bedding or the like, but although the cellulose group fiber has a superior water absorption, the rate of discharge of water absorbed in the cellulose group fiber is low. Namely when sweat is generated, the cellulose fiber absorbs and is swollen by the absorbed sweat, and does not discharge the sweat. Therefore the product of the cellulose fiber is uncomfortable when worn.

Further, to improve a low water absorption of a synthetic fiber, an attempt has been made to improve the water absorption by applying a hydrophilic substance such as a polyethylene glycol, a methoxy methyl nylon on a surface of the synthetic fiber. The water absorption of this fiber, however, is still poor, and when a large amount of the hydrophilic substance is used, the handling of the obtained fabric becomes remarkably inferior. Further the hydrophilic substance is easily removed from the fabric by repeated washing.

SUMMARY OF THE INVENTION

An object of the present invention is to provide a fabric having a superior water absorption and diffusion and discharge of a water content compared with a conventional fabric, and further, a fabric to which a water proofness and moisture condensation proofness can be applied as desired.

Another object of the present invention is to provide a method of manufacturing the above-mentioned fabric.

Therefore, according to the present invention, there is provided a fabric comprising a base fabric and a chitin group substance applied through a synthetic resin to the base fabric.

The fabric in accordance with the present invention can be provided in two types, i.e., a fabric in which the chitin group substance is fixed through the synthetic resin in a dispersed state to the base fabric, and a fabric comprising the base fabric and at least two layers of the synthetic resin, at least one layer of which includes the chitin group, and the at least two layers are sequentially applied on a surface of the base fabric. The former fabric can be manufactured by immersing the base fabric in a solution including the chitin group substance and the synthetic resin and heating the immersed fabric, and the latter fabric can be manufactured by coating the base fabric with a solution including the chitin group substance and the synthetic resin and heating the coated fabric. The term "a chitin group substance" as used in the present application, includes a chitin, a compound deacetylated from the chitin, i.e., a chitosan, and a carboxylated chitin or the like. Usually, an acetylation of the chitosan is 50% or more.

BRIEF DESCRIPTION OF THE DRAWINGS

FIGS. 1 to 4 show examples of the fabric comprising a base fabric and at least two layers of the synthetic resin, at least one layer of which includes the chitin group substance, wherein at least two layers are sequentially applied on a surface of the base fabric in accordance with the present invention, wherein FIG. 1 is a cross sectional view of an embodiment of the above fabric in accordance with the present invention;

FIG. 2 is a cross sectional view of another embodiment of the above fabric in accordance with the present invention;

FIG. 3 is a cross sectional view of yet another embodiment of the above fabric in accordance with the present invention; and FIG. 4 is a cross sectional view of a further embodiment of the above fabric in accordance with the present invention.

DESCRIPTION OF THE PREFERRED EMBODIMENTS

Figure 1:
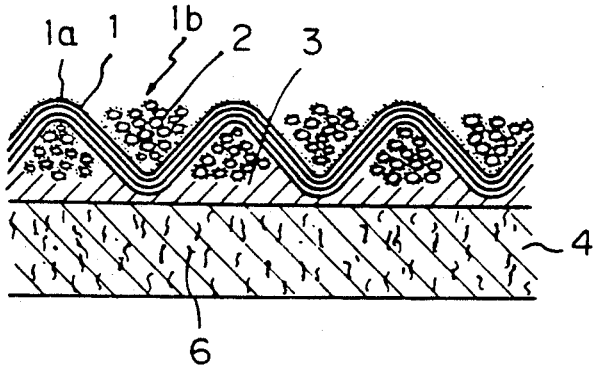

To facilitate the understanding of the present invention, the essential technical concept of the fabric in accordance with the present invention is described in detail with reference to the attached drawings.

The chitin can be easily and widely obtained from natural source. In particular, large amount of chitin can be found in a crustacea of an inveterate such as a lobster, a crab or the like, or an insect such as a beetle, a cricket or the like. Further, sufficient amounts of chitin can be found in the cell membrane of fungi. Method of manufacturing the chitin from the above raw material are disclosed in the Journal of Biological Sciences Research, Vol 7. P168 (1954), Journal of Organic Chemistry, Vol27, P1161 (1962), and Fishery Technology, Vol 11, P50 (1974).

The chitin group substance has a chemical structure similar to that of a cellulose, but has a better crystallization property than cellulose. Therefore, the chemical reactivity of the chitin group substance is low, and the chitin group substance has different characteristics to the cellulose, such as a low solubility and a low swelling, and thus is not utilized as widely as, for example, a polysaccharide such as cellulose or the like. The chitin group substance is currently used mainly in a cohesive agent for a sludge treatment, as a chitosan which is a derivative of chitin.

The chitin group substance, however, has other superior features compared with other compounds. Namely, the chitin group substance has a superior adaptability to a living organism and can be used as a sewing thread in a medical operation, and as an artificial skin. Further, the chitin group substance has a superior anti-fungus property against a colon bacillus, a ring worm bacillus, a staphylococcus or the like. Therefore, it is possible to provide a fabric with an anti-fungus property, by using this property of the chitin group substance. In this case, since the adaptability of the chitin group substance to living organisms is superior, the skin will not be injured. The inventors of the present application found that a water absorption and a discharge property of water in a fabric can be remarkably improved by applying the chitin group substance to the fabric.

A woven fabric, a knitted fabric, a nonwoven fabric or the like can be used as a base fabric in the fabric in accordance with the present invention, and a natural fiber such as cotton, ramie, a chemical fiber such as viscose rayon, cuprammonium rayon, acetate, a synthetic fiber such as a polyamide fiber, a polyester fiber, a polyacrylonitrile fiber can be used as a fiber constituting the base fabric, and the fibers can be used as a filament or as a staple fiber.

The chitin group substance is used with a synthetic resin to prevent a separation of the chitin group substance from the fibers. The chitin group substance is used after being uniformly dispersed in the synthetic resin, and therefore, even if the synthetic resin has no water absorption, a water content in contact with the chitin group substance can be rapidly absorbed and diffused into the synthetic resin and the water content absorbed in the synthetic resin is rapidly discharged to the atmosphere. When the synthetic resin has a good moisture permeability, this absorption and discharge are further accelerated.

As the chitin group substance in accordance with the present invention, the chitin itself and a derivative of chitin can be used. Preferably, a chitosan having a deacetylation of 50% or more, or a carboxylated chitin, is used.

A polyurethane resin, a polyacrylic resin, a polyvinyl chloride resin, a modified acid amide resin, a polyacrylate resin, a polyvinyl alcohol resin or the like can be used as the synthetic resin in the base fabric in accordance with the present invention.

When a solution including the chitin group substance and the synthetic resin is coated on a surface of the base fabric, preferably a synthetic resin having a moisture permeability of 3,000 g/m$^2$/24 hrs or m ore is used. Two methods of providing the moisture permeability to the synthetic resin ca be used; a mechanical method or a chemical method. Further, the mechanical method can be divided into two methods, i.e., a dry method and a wet method. For example, as the dry method, a method in which a solution including the chitin group substance, the synthetic resin and an organic solvent is prepared, the solution is suitably coated, depending on a type of the fabric desired, on the basic fabric, and the coated fabric is dried to evaporate the organic solvent and form a plurality of fine through-pores in the fabric can be used, and as the wet method, a method in which a solution including the chitin group substance, the synthetic resin and a solvent is prepared, the solution is suitably coated, depending on a type of the fabric desired, on the base fabric, and the coated fabric is immersed in a liquid capable of solidifying t he synthetic resin and dissolving the solvent, to form a plurality of fine through-pores in the fabric, can be used.

As the chemical method of providing a moisture permeability to the synthetic resin, a method blending a hydrophilic resin such as a polyethylene glycol, an amino-acid resin or the like into the synthetic resin or a method using a copolymer of a hydrophilic monomer and a hydrophobic polymer, can be used.

In the fabric manufactured by immersing the base fabric in the solution including the chitin group substance and the synthetic resin, preferably a content of the chitin group substance in the base fabric is at least 0.1 wt.%, more preferably 0.2 wt% or more, and a content of the synthetic resin in the base fabric is between 3 wt% and 6 wt%, more preferably between 0.4 wt% and 4 wt%.

Further, in the fabric manufactured by coating the solution including the chitin group substance and the synthetic resin on the surface of the base fabric, preferably a content of the chitin group substance in the layer including the chitin group substance and the synthetic resin is at least 0.5 wt%, more preferably 1 wt% or more, and a content of the synthetic resin in the base-fabric is between 10 wt% and 80 wt%, more preferably between 15 wt% and 70 wt%. To increase the adhesion between the synthetic resin layer and the base fabric, or between the synthetic resin layer and an adjacent synthetic resin layer thereof, in this type of the fabric, preferably a crosslinker and a synthetic resin having a reactivity with the crosslinker are used. A polyurethane resin, a polyacrylate resin, a modified acid amide resin, or a polyvinyl alcohol resin can be used as the synthetic resin reactive with the crosslinker.

The following compounds can be used, for example, as the crosslinker, an epoxy compound of an epichlorohydrin, an ethylene glycol diglycidylether, a polyethylene glycol diglycidylether, a trimethylolpropane triglycidylether, a glycerin diglycidylether, or a 1,6-hexadiol dillether; an isocyanate compound such as 2,4-tolylene diisocyanate, hexamethylene diisocyanate, methylene bisphenyl isocyanate, methylene bis 4-cyclohexylicisocyanate isophorone diisocyanate, trimethylolpropane-hexamethylene diisocyanate, or the like; a polyol compound of an ethylene glycol, trimethylolpropane, glycerin, polyoxyethylene glyol or the like; a bisacrylamide such as N,N methylene bisacrylamide; and an ester compound of di, or trimethacrylic acid obtained by reacting a polyepoxide with an acrylic acid or the methacrylic.

The crosslinker is generally used in an amount of between 0.3 wt% and 10 wt%, more preferably between 0.5 wt% and 5 wt% to the weight of the synthetic resin.

The features of the fabric in accordance with the present invention will be explained hereafter.

First, the chitin group substance is adhered on a surface of each fiber constituting the base fabric, when the completed fabric is manufactured by immersing the base fabric in the solution including the chitin group substance and the synthetic resin. Therefore, the fabric has a superior water absorption and diffusion and discharge of the water content, and a water content such as a sweat or the like in a fabric will not form drops but will be absorbed by the fabric.

In the fabric manufactured by coating the solution including the chitin group substance and the synthetic resin on the surface of the base fabric, since the fabric is covered with the synthetic resin layer, the fabric has a superior water proofness, and as the chitin group substance is contained in the synthetic resin, the fabric has superior water absorption, diffusion and discharge properties. Further, if a synthetic resin having a good moisture permeability is used, the above feature is enhanced.

A layer of the synthetic resin having a moisture permeability of 3,000 g/m$^2$/24 hours or more, which can be obtained, for example, by providing a number of through-pores in the layer, can be coated with a layer including the chitin group substance and the synthetic resin. Note, two or more layers including the chitin group substance and the synthetic resin can be used.

The thickness of the synthetic resin layer may be optionally determined, but when two or more synthetic resin layers are used, the thickness of each layer is preferably between 2 μm and 30 μm, more preferably between 5 μm and 15 μm. To further improve the water repellency, preferably a water repellant of a fluorine group is applied.

The methods of manufacturing the fabric in accordance with the present invention will be explained hereafter.

First, a chitin group substance is dissolved in a solution of a dilute acid.

Note, an acetic acid, lactic acid, formic acid, succinic acid, and gluconic acid can be used as the dilute acid, but formic acid is more preferably. Preferably the dilute acid has a concentration of between 1 wt% and 10 wt%. A concentration of the chitin group substance in the solution of the dilute acid is determined in accordance with a solubility and viscosity thereof, but the concentration of the chitin group substance in the solution of the dilute acid is preferably between 0.3 wt% and 1 wt%.

When the solution of the chitin group substance is used to manufacture the fabric comprising the base fabric and the chitin group substance applied through a synthetic resin to the base fabric, the solution of the chitin group substance is directly blended with a synthetic resin emulsion, and this solution including the chitin group substance and the synthetic resin is applied to the base fabric by immersing the base fabric in the solution and squeezing the base fabric, or the solution is absorbed by the base fabric in a jet dyeing apparatus or the like and the base fabric is squeezed. In this case, to prevent a separation of the chitin group substance and the synthetic resin from the base fabric, preferably a fixing agent is added to the solution.

When the solution of the chitin group substance is used to manufacture the fabric comprising the base fabric and at least two layers of the synthetic resin, at least one layer of which includes the chitin group, and the at least two layers are sequentially applied on a surface of the base fabric, for example, the solution of the chitin group substance is first blended with a solution of the synthetic resin solved by an organic solvent and an emulsion is prepared from the blended solution by adding an emulsifier. To prevent peeling between the base fabric and the synthetic resin layer or between the synthetic resin layer and a layer adjacent thereto, preferably a fixing agent is added to the solution. Further, a pigment, a metal powder such as an aluminium, a carbon, a ceramic or the like can be added to the solution.

The blended solution can be coated on the base fabric by a method in which the blended solution is directly coated on the base fabric by a knife coater, a method in which a coating layer having a constant thickness of the blended solution is made by a bar coater, or a method using a reverse coater, a roto-gravure roll coater or the like.

A drying treatment is applied to the coated fabric, at a temperature of, preferably, between 50° C. and 100° C. To increase an adhesion between the base fabric and the resin layer or between two resin layers, preferably a drying treatment at between 100° C. and 130° C. is further applied to the dried fabric.

To provide a moisture permeability to the synthetic resin, preferably a method in which a hydrophilic resin such as a polyethylene glycol, an amino acid resin or the like is blended in the blended solution or copolymerizated with the blended solution, or a method forming a plurality of fine through-pores in the synthetic resin by blending an organic solvent such as a methyl ethyl keton, a toluene or the like into the blended solution, and heating to evaporate the organic solvent, is used.

Preferably a water repellent is applied to the basic fabric before coating the fabric with the blended solution. Further, a method can be adopted in which the base fabric is first coated with a synthetic resin having a moisture permeability and including the water repellent and then the synthetic resin including the chitin group substance is coated on the coated layer of the fabric. Conversely, a method can be adopted in which the base fabric is first coated with the synthetic resin including the chitin group substance and then the synthetic resin having a moisture permeability and including the water permeability is coated on the coated layer of the fabric.

These two types of fabrics obtained in accordance with the present invention can be used for various purposes without another treatment, but preferably a fixing treatment is applied to the obtained fabric to strengthen the bond between the chitin group substance and the base fabric. The fixing agent can be optionally selected according to the type of fibers constituting the base fabric. For example, a fixing agent such as a polyamine, polyvinylamine, polyacrylonitrile group polymer, polycation such as a quartaranized polyethylene imine or the like, can be applied to a cellulose fiber such as cotton, ramie, rayon or the like. A metal-containing synthetic tannin derivative or the like can be applied to a wool fiber, and a tannin acid or a formalin condensate of a phenol sulfonic acid or the like can be applied to a polyamide fiber as the fixing agent.

Figure 2:
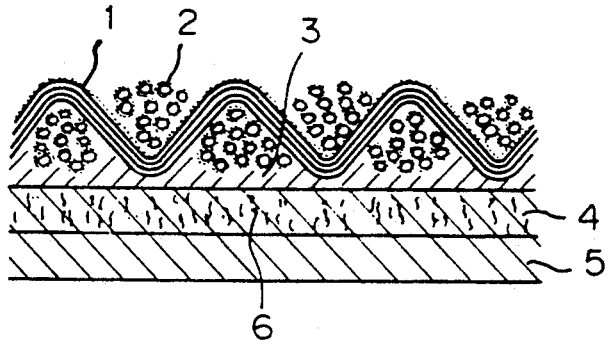
Figure 3:
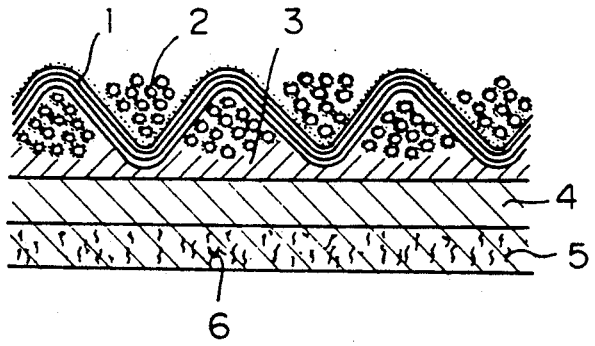
Figure 4:
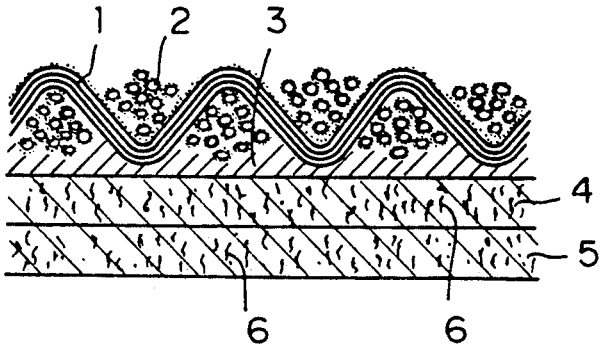

FIGS. 1 to 4 show a cross sectional view of an embodiment of the fabric comprising a base fabric and at least two layers of the synthetic resin, at least one layer of which includes the chitin group substance, and the at least two layers are sequentially applied on a surface of the base fabric in accordance with the present invention respectively. In FIG. 1, numeral 1 denotes a base fabric, 2 a portion including a water repellent and an isocyanate compound, 3 a layer including a synthetic resin having a moisture permeability, and 4 a layer including the chitin group substance and the synthetic resin. FIGS. 2 to 4 show cross sectional views of other embodiments of the fabric in accordance with the present invention, in which two layers 4 and 5 are arranged on the underside of the layer 3, in place of the one layer 4 in the fabric illustrated in FIG. 1. In FIGS. 1 to 4, the layer plotted with a plurality of marks 6 includes the chitin group substance. It is possible to arrange two or more layers, for example, five layers, on the underside of the layers. Further, although a woven fabric 1 constituted with warp yarns la and weft yarns lb is illustrated as the base fabric, a knitted fabric or a nonwoven fabric can be also used as the base fabric.

When the fabric illustrated in FIGS. 1 to 4 is used in a state that the base fabric 1 is on the outside, the penetration of rain water or the like is prevented by the synthetic resin layer, and a vapour of sweat is rapidly absorbed due to the superior water absorbing effect of the chitin group substance arranged in the layer 4 or layers 4 and/or 5, and discharged through the layer 3 having a moisture permeability. Therefore, a water condensation on an inner side of the fabric used, for example, sports wear, does not occur.

When the quantity of sweat emitted is large compared with the moisture permeability of the layer 3, or a discharge of the vapour of the sweat is not easy due to a high relative humidity of the atmosphere, the vapour of sweat can be absorbed and diffused in a large volume of the layer including the chitin group substance and the vapour of sweat can be successfully discharged from the fabric. Therefore, water condensation inside the sports wear also can be prevented.

As described in detail above, the water absorption, diffusion and discharge of water in the fabric in accordance with the present invention are remarkably superior compared with conventional water absorbing fabrics. Therefore, a vapour of sweat or sweat per se can be rapidly absorbed by the fabric and the vapour can be discharged from the fabric. If the fabric in accordance with the present invention is manufactured by a coating method, waterproofness is also applied. Further, since the chitin group substance has a superior antifungal property, a product having a good antifungal property can be made of the fabric in accordance with the present invention.

The fabric in accordance with the present invention can be broadly used, for example, in water proofing wear such as a ski wear, windbreaker, sportswear, underwear, diaper covers, sanitary goods, sports hat, shoe linings, bedding, wall paper, or the like.

The present invention will now be further explained by way of examples, which in no way limit the invention.

EXAMPLES 1 AND 2

A cotton twill fabric having the following constitution was prepared as a base fabric.

Warp yarn: 40s
Weft yarn: 40s
Ends per inch plus picks per inch: 190
Weight per unit area: 120 g/m A deacetylated chitin having a degree of acetylation of 80% or more, i.e., "Daichitosan" supplied from DAINICHISEIKA COLOR & CHEMICALS MFG CO., LTD., was added to an aqueous solution of an acetic acid to form a chitosan solution having a concentration of 0.5%, and completely dissolved by a dispersing apparatus.

The treating liquids having the following compositions were prepared.

| | Example 1 | Example 2 |
|---|---|---|
| 0.5% chitosan solution | 200 parts | 900 parts |
| Riken resin RJ-36 | 25 " | 25 " |
| Parasolbe 272 | 40 " | 40 " |

-continued

| | Example 1 | Example 2 |
|---|---|---|
| Paracat P | 4 " | 4 " |
| Dicsilicone Softener 200 | 5 " | 5 " |
| Water | 726 " | 26 " |

Riken resin RT-36 is available from MIKIRIKEN INDUSTRIAL CO., LTD., Parasolbe 272 and Paracat P are available from OHARA PARAGIUM CHEMICAL CO., TLD., and Dicsilicone Softener 200 is available from DAINIPPON INK AND CHEMICALS INC.

The cotton fabric was immersed at room temperature for three seconds in the above two treating liquids, respectively, squeezed at a squeezing ratio of 100% by a mangle, and then heated at 120° C. for 60 sec.

Each primary treated fabric was subjected to second treatment, to fix firmly the chitosan to an outside and an inside of the fabric. Namely, each treated fabric was immersed at room temperature for three minutes in a 1% water solution of a polydimethyl ammonium chloride, i.e., Danfix 125 available from NITTO BOSEKI CO., LTD.

An antifungal property, a water absorption speed according to JIS L-1096A, and a skin patch test on ten men and ten women, were measured for the two above treated fabrics, and the obtained values are shown in Table 1.

An evaluation of an antifungal property of the fabric is carried out by the following fungas number measuring method.

The following fungus is suspended into a sterilizated liquid bouillon, and 0.2 ml of the liquid is inoculated on a test piece of 0.2 g. The test piece is cultured at 37° C. for 18 hours. Numbers of live fungus before and after the culturing operation are measured, respectively and the differences between the increase and the decrease of the generation of staphyococcus are calculated by the following equation.

Fungus: Staphylococcus aureus ATCC 6538P (IFO 12732)
Weight of test piece: 0.2 g
Temperature and time of culturing operation: 37° C., 18 hours $$\text{Increase and Decreas of Generation of Staphyococcus (I.D.G.M.)} = \text{Log}_{10}\frac{\text{Number of Live Gunglus appeared on Test Piece after culturing operation of 18 hours}}{\text{Number of Live Funglus appeared on Test Piece Just before Culturing Operation (Number of Live Funglus inoculated)}}$$

$$\text{Differences between Increase and Decrease of Generation of Staphyococcus} = \text{Value of } I.D.G.M. \text{ of Untreated Test Piece} - \text{Value of } I.D.G.M \text{ of Treated Test Piece}$$

A standard white cloth of a cotton is used as the untreated test piece.

EXAMPLES 3 AND 4, COMPARATIVE EXAMPLES 1 AND 2

A nylon textured yarn fabric having the following constitution was prepared as a base fabric.

Warp yarn: 70d

Weft yarn: 70d

Ends per inch plus picks per inch: 200

Weight per unit area: 100 g/m$^2$

The same chitosan solution as that used in Examples 1 and 2 was prepared, and the four treating liquids having the following compositions were prepared.

| | Example 3 | Example 4 | Comparative Example 1 | Comparative Example 2 |
|---|---|---|---|---|
| 0.5% chitosan solution | 200 | 900 | 0 | 40 |
| Riken resin RJ-36 | 10 | 10 | 10 | 10 |
| Parasolbe 272 | 40 | 40 | 40 | 40 |
| Paracat P | 4 | 4 | 4 | 4 |
| Dicsilicone Softener 200 | 2 | 2 | 2 | 2 |
| Water | 744 | 44 | 904 | 944 |

The nylon fabric was treated at a temperature of 60° C., for 10 minutes in the four above treating liquids, respectively by a jet dyeing machine, squeezed at a squeezing ratio of 120% by a centrifugal hydroextracter, and then heated at 120° C. for 90 sec.

Each primary treated fabric was subjected to a second treatment to firmly fix the chitosan to an outside and an inside of the fabric. Namely, each treated fabric was immersed at room temperature for three minutes in a 0.5% water solution of an aromatic sulfonate compound, i.e., Sunlife TN available from NIKKA CHEMICAL IND. CO., LTD.

The same tests as carried out in Examples 1 and 2 were applied to the treated fabrics of Examples 3 and 4, and Comparative Examples 1 and 2, and the obtained values are shown in Table 1.

TABLE 1

| | | Example 1 | Example 2 | Example 3 | Example 4 | Comparative Example 1 | Comparative Example 2 |
|---|---|---|---|---|---|---|---|
| Quantity of Chitin for Base Fabric (wt %) | | 0.10 | 0.45 | 0.12 | 0.54 | 0 | 0.05 |
| Antifungal Property | Original | 5.06 or more | 6.08 or more | 6.10 | 6.23 or more | 0.05 | 0.24 |
| | After home loundering (10 times) | 3.10 | 4.15 | 4.56 | 5.18 | 0.03 | 0.05 |
| Water Absorption Speed | Original | 1 sec or less | 1 sec or less | 4 sec or less | 4 sec or less | 5 sec | 5 sec |
| | After 10 hrs | 1 sec or less | 1 sec or less | 4 sec or less | 4 sec or less | 18 sec | 18 sec |

Note: When a value of a differences between increase and decrease of generation of Staphyococcus is 1.6 or more, it is evaluated that a fabric has a good antifungal property.

EXAMPLES 5 AND 6, COMPARATIVE EXAMPLE 3

First, the fabric of Example 5 is described in detail.

A nylon filament fabric having the following constitution was prepared as a base fabric:

Warp yarn: 70d

Weft yarn: 70d

Ends per inch plus picks per inch: 210

The nylon fabric was immersed in a blended liquid of a fluorine group repellent in which two parts of FC232 available from Sumitomo 3M Limited and 100 parts of water were blended, and an isocyanate compound; i.e., Takenate B 830W available from Takeda Chemical Industries, Ltd., using 10 wt% of the fluorine group repellent, and was heated at 160° C. for 60 sec. The isocyanate compound was used as an adhesive. The obtained fabric was further applied with a heat treatment by a heat calender having a pressure of 10 tons per a width of 2000 mm, to smooth a side of the fabric. The air permeability measured by a Frazier method of the obtained fabric was about 15 cc/cm$^2$ . sec, and thus a base fabric having a water repellency was manufactured.

A liquid having the following composition was prepared to make a first layer.

| | |
|---|---|
| W/O Type Polyurethane Resin Emulsion available from Sanyo Chemical Industry Co., Ltd. as Sanprene UE-1000N: | 100 parts |
| Toluene: | 40 parts |
| Methyl ethyl ketone: | 20 parts |
| Water: | 10 parts |
| Fluorine group repellent used for making the first layer: | 20 parts |
| Isocyanate compound available from Dainippon ink and Chemicals Inc. as Burnock DN950: | 5 parts |

The above liquid was coated on the fabric having the first layer at an adhesive weight of the liquid of 30 g/m$^2$, by a knife coater, and the fabric was dried. The obtained fabric contained the first layer at 6.0 g/m$^2$. The first layer was a moisture permeable and water proof layer having a plurality of throughpores A liquid having the following composition was prepared to make a second layer.

First, a chitin dilute acid solution was prepared by adding 0.5 wt% of a deacetylated chitin having a degree of acetylation of 80%, i.e., Kitosan A available from Katakura Chikkarin Co., Ltd to a 10% solution including an acetic acid and a lactic acid at a rate of 1 to 1, standing the blended solution for 24 hrs to cause a swelling of the deacetylated chitin by the solution, and completely dissolving the deacetylated chitin by a dispersing apparatus.

The liquid used to make the second layer was prepared by blending the chitin dilute acid solution with the following materials:

| | |
|---|---|
| Chitin dilute acid solution: | 55 parts |
| W/O Type polyurethane Resin Emulsion supplied from | 100 parts |

-continued

| | |
|---|---|
| Dainichi Seika Color & Chemical Mfg Co., Ltd as H1-Muren X-3038: | |
| Toluene: | 20 parts |
| Methyl ethyl keton: | 20 parts |
| Isocyanate compound, i.e., Burnock DN950: | 1.5 parts |

The above liquid was coated on the fabric having the first layer, at an adhesive weight of the liquid of 100 g/m$^2$, by a bar coater arranged on the first layer of the fabric with a clearance of 100 μm between a surface of first layer and a surface of the bar coater, and dried at 70° C. for 2 minutes. The obtained fabric included the second layer at 15 g/m$^2$. The second layer was a water absorptable urethane and chitosan layer having a plurality of through-holes.

A liquid having the following composition was prepared to make a third layer, which was provided to improve an abrasion resistance of the fabric and enhance a decorative effect of the fabric.

| | |
|---|---|
| Chitin dilute acid solution: | 40 parts |
| W/O type Polyurethane Resin Emulsion available from Sanyo Chemical Industry Co., Ltd. as Sanprene UE-1000N: | 100 parts |
| Toluene: | 20 parts |
| Methyl ethyl keton: | 20 parts |
| Isocyanate compound: | 3 parts |
| Organic pigment: | a little |

The above liquid was coated on the fabric having the second layer at an adhesive weight of the liquid of 40 g/m$^2$, by a knife coater, and dried at 80° C. for 2 minutes in an oven. The obtained fabric included the third layer at 8.0 g/m$^2$.

Next, to strengthen the adhesion between a base fabric and a resin in the first layer and between resins in the adjacent layers, and the fabric was further heat treated at 120° C. for 2 minutes. Further, to enhance the effect of the chitin, the obtained fabric was immersed in a solution of a 1% chitin dilute acid solution and a resin at the same quantity as that of the 1% chitin dilute acid solution, and was dried.

The chitin content to the resin of the obtained fabric, i.e., Example 5 in the present invention, was 1.04 wt%. A fabric of Example 6 having the chitin content of 2.08 wt% and a fabric of Comparative Example 3 having the chitin content of 0.3 wt% were manufactured in the same manner as used in Example 5, except that a quantity of the deacetylated chitin in the chitin dilute acid solution was changed.

To evaluate the properties of the fabric obtained in accordance with the present invention, the following items were measured:

Water resistance according to JIS-L-1092 "Low water pressure method"

Water repellency according to JIS-L-1092 "Spray method"

Moisture permeability according to JIS-L-1099 (A-1)

Abrasion resistance

Moisture condensation

Moisture absorption

Water absorption speed according to JIS-L-1096 (A)

The method of testing the abrasion resistance was carried out as follows:

Two test pieces of a cotton fabric, one dry and the other wet, were prepared. The test pieces were laid on a fabric to be tested and a weight of 200 g loaded on the test piece. Each test piece was moved reciprocally 500 times on the fabric to be tested, and the appearance of the resin layer of the fabric under test was evaluated by the following standards:

Degree of Evaluation

5: Not change

4: Slight scratching

3: Many scratches

2: Slight peeling

1: Much peeling

The method of testing the moisture condensation was carried out as follows:

An artifical climate room adjusted to a temperature of 20±1° C. and a relative humidity of 80%, and including a water bath controlled at 40±1° C., was prepared. A fabric to be tested was arranged at a position above a surface of the hot water in the water bath, by about 2 cm, in a state such that the resin layer of the fabric was opposite to the hot water, and left for 20 min. The edge of the fabric and side walls of the water bath were enclosed by side walls of the artificial climate room, to prevent air movement in a space between the fabric and the surface of the hot water.

The moisture condensation appearing on a surface of the resin layer of the fabric was evaluated by the following standards:

| Degree of Evaluation | |
|---|---|
| High | Water drops appeared over the whole surface. |
| Medium | Water drops appeared on 30% of the surface |
| Low | Some water drops appeared on the surface. |
| None | Few water drops appeared. |

In this test, the water drops appeared on the resin layer are gathered by a filter paper, and a water content remaining in the fabric is measured and evaluated as the moisture absorption of this fabric. The results are shown in Table 2.

EXAMPLES 7 AND 8, COMPARATIVE EXAMPLE 4

First, a fabric of Example 7 is described in detail.

A tricot knitted fabric of a polyester filament having the following constitution was prepared as a base fabric.

| | |
|---|---|
| Denier of a yarn: | 40d |
| Number of walls: | 50 per inch |
| Number of courses: | 55 per inch |

The base fabric was subjected to the water repellent treatment in the same manner as in Example 5, except that a heating treatment was applied at a temperature of 140° C.

A first layer of the fabric in this Example 6 was made in the same manner as in Example 5.

A liquid having the following composition was prepared to make a second layer.

| | |
|---|---|
| 20% toluene solution of an acrylic | 80 parts |

-continued

| | |
|---|---|
| resin, i.e., Toaacron XE-2511 available from Toa Paint Co., Ltd.: 25% toluene and isopropyl alcohol solution of a moisture permeable one pack type urethane, i.e., NPU-5 available from Dainichiseika Color & Chemical Mfg Co., Ltd.: | 20 parts |
| Toluene: | 20 parts |
| Isocyanate compound, i.e., Burnock DN950: | 3 parts |
| 0.5% water solution of Carboxyl methyl chitin, i.e., CM chitin available from Katakura Chikkarin Co., Ltd.: | 20 parts |

The above liquid was coated on the fabric having the first layer at an adhesive weight of the liquid of 100 g/m$^2$, by a reverse coater, and dried at 70° C. for 2 minutes. The obtained fabric included the second layer at 18 g/m$^2$. The second layer was a water permeable chitin layer having a water absorption due to a plurality of through-pores.

Next, to strength the adhesion between a base fabric and a resin in the first layer and between resins in the adjacent layers, the above fabric was further heat treated at 120° C. for 2 minutes.

The chitin content to the resin of the obtained fabric, i.e., Example 7 in the present invention was 0.5 wt%. A fabric of Example 8 having a chitin content of 1.0 wt% and a fabric of Comparative Example 4 having a chitin content of 0.3 wt% were manufactured in the same manner as in Example 7, except that a quantity of the deacetylated chitin in the chitin dilute acid solution was changed.

The fabrics of Examples 7 and 8, and Comparative Example 3 were evaluated by the same method as used to evaluate Example 4, and the results are shown in Table 2.

TABLE 2

| | Example 5 | Example 6 | Comparative Example 3 | Example 7 | Example 8 | Comparative Example 4 |
|---|---|---|---|---|---|---|
| Chitin content to resin in fabric (%) | 1.04 | 2.08 | 0.3 | 0.5 | 1.0 | 0.3 |
| Water resistance (mm) | 2,000 | 2,000 | 2,000 | 700 | 750 | 700 |
| Water repellency | 100 | 100 | 100 | 100 | 100 | 100 |
| Moisture permeability (g/m$^2$/24 hrs) | 7,500 | 7,500 | 5,600 | 8,000 | 8,200 | 6,500 |
| Abrasion resistance Dry | 5 | 5 | 5 | 4 | 4 | 4 |
| Wet | 4 | 4 | 4 | 3 | 3 | 3 |
| Moisture condensation | No | No | Medium | No | No | Medium |
| Moisture absorption (%) | 86 | 88 | 26 | 76 | 80 | 38 |
| Water absorption speed (sec) | 10 | 10 | 30 or more | 10 | 10 | 30 or more |

COMPARATIVE EXAMPLES 5 AND 6

In Comparative Example 5, a base fabric was subjected to a water repellency treatment using the same agent and conditions as in Example 3, and to a heat treatment using the same method as in Example 5.

A liquid having the following composition was prepared to make a first layer.

20% solution of polyurethane resin: 100 parts

Solvent type fluorine group water repellent: 1 part

30% solution of a trimethyl propane hexamethylene-diisocyanate: 1 part

The above liquid was coated on the fabric having the first layer at an adhesive weight of the liquid of 250 g/m$^2$, by a conventional wet type coagulating method, to obtain the fabric of Comparative Example 5.

The fabric of Comparative Example 6 was manufactured by coating a moisture permeable polyurethane resin liquid having a solid content of 25% and comprising a hydrophilic glycol such as a polyethylene glycol or the like on a toricot knitted fabric of a polyester filament treated with the same treatment as that used to apply a water repellency in Example 7, by a reverse roll coating method, to make first coating layer having a weight per unit area of 10 g/m$^2$ to 12 g/m$^2$. The thus-obtained fabric was moisture permeable and water proof, and had no through-pores.

The fabrics of Comparative Examples 5 and 6 were evaluated by the same measuring method as used to evaluate Example 4, and the results are shown in Table 3.

TABLE 3

| | Comparative Example 5 | Comparative Example 6 |
|---|---|---|
| Chitin content to resin in fabric (%) | 0 | 0 |
| Water resistance pressure (mm) | 1,500 | 700 |
| Water repellency | 100 | 100 |
| Moisture permeability (g/m$^2$/24 hrs) | 4,500 | 6,000 |
| Abrasion resistance Dry | 4 | 4 |
| Wet | 3 | 3 |
| Moisture condensation | High | Medium |
| Moisture absorption (%) | 7 | 10 |
| Water absorption speed (sec) | 60 or more | 60 or more |

As shown by a comparison of Table 2 and Table 3, it is apparent that the fabrics in accordance with the present invention have a superior moisture permeability, ability to prevent moisture condensation, and moisture absorption, compared with the conventional moisture permeable water proofing fabrics.

EXAMPLE 9

The fabric of Example 9 had the same constitution as that of Example 5 for a base fabric, a water repellent treatment, a first layer, and a second layer, except that a synthetic resin layer without a chitin group substance was used for a third layer. A cross sectional view of the fabric of Example 9 is shown in FIG. 2. Since the outer most layer, i.e., the third layer in Example 9, is a moisture permeable layer, the fabric of Example 9 has a superior moisture permeability, ability to prevent moisture condensation, and moisture absorption.

EXAMPLE 10

The fabric of Example 10 had the same constitution as that of Example 5 for a base fabric, a water repellent treatment a first layer, and a third layer, except that a synthetic layer without a chitin group substance was used for a second layer. A cross sectional view of the fabric of Example 10 is shown in FIG. 3. The third layer in Example 10 is a moisture permeable layer and moisture or water such as sweat or the like absorbed in the third layers can be easily removed from the third layer through the second layer to the first layer.

EXAMPLE 11

The fabric of Example 11 was manufactured by directly applying a moisture permeable synthetic resin layer including a chitin group substance to a base fabric. This fabric also had relatively superior qualities, but when a permeation of the synthetic resin into the base fabric became large in a direction of a thickness of the fabric, the synthetic resin was apt to pass through the fabric, resulting in a hard handling and a lower tear strength.

EXAMPLE 12

The fabric of Example 12 was manufactured by directly applying a moisture permeable synthetic resin layer including a chitin group substance to a base fabric previously subjected to a water repellent treatment. Since the base fabric was given a water repellency, the fabric of Example 12 did not have the disadvantages of the fabric of Example 11.

EXAMPLE 13

The fabric of Example 13 was manufactured by combining the method of Example 1 and the method of Example 7. Namely, first, a base fabric was immersed in a liquid including a chitin group substance and then subjected to a heat treatment. The fabric of Example 13 was manufactured by coating a moisture permeable synthetic resin layer on the above treated base fabric, and further, applying a polyurethane resin layer including the chitin group substance and having a plurality of through-pores.

EXAMPLE 14

The fabric of Example 14 was manufactured by applying a polyurethane resin layer including the chitin group substance on the polyurethane resin layer of the fabric of Example 13. The abrasion resistance of the fabric of Example 14 was improved by twice coating the polyurethane resin layer.

EXAMPLE 15

The fabric of Example 15 was manufactured by using a decalcomania transferring coat system. Namely, a moisture permeable synthetic resin layer including the chitin group substance was formed on release paper, a moisture permeable synthetic resin layer used as an adhesive was arranged on the first layer, and a base fabric was arranged on the second layer. After pressing to combine the two synthetic layers and the base fabric, the release paper was peeled from the fabric.

We claim:

1. A fabric comprising a base fabric and a chitin group substance applied through a synthetic resin to the base fabric, said synthetic resin being at least one selected from polyurethane resin, a polyacrylic resin, a polyvinyl chloride resin, a modified polyamide resin, a polyacrylic ester resin and a polyvinyl alcohol.

2. A fabric according to claim 1, wherein said fabric is comprised of the base fabric and at least two layers of the synthetic resin at least one layer of which includes the chitin group substance, and said at least two layers are sequentially applied on a surface of the base fabric.

3. A fabric according to claim 2, wherein a first layer of a synthetic resin having an adhesion property is directly applied on the surface of the base fabric, and a second layer including the chitin group substance and the synthetic resin is applied on the first layer.

4. A fabric according to claim 2, wherein a first layer of a synthetic resin having an adhesion property is directly applied on the surface of the base fabric, a second layer including the chitin group substance and the synthetic resin is applied on the first layer, and a third layer including only the synthetic resin is applied on the second layer.

5. A fabric according to claim 2, wherein a first layer of a synthetic resin having an adhesion property is directly applied on the surface of the base fabric, a second layer including only the synthetic resin is applied on the surface of the first layer and a third layer including the chitin group substance and the synthetic resin is applied on the second layer.

6. A fabric according to claim 2, wherein a first layer of a synthetic resin having an adhesion property is directly applied on the surface of the base fabric, and a layer including the chitin group substance and the synthetic resin is used as a second layer applied on the first layer and a third layer applied on the second layer.

7. A fabric according to claim 2, wherein a water repellent is included in at least a layer including only the synthetic resin.

8. A fabric according to claim 2, wherein a content of the chitin group substance in the layer including the chitin group substance and the synthetic resin is at least 0.5wt%.

9. A fabric according to claim 2, wherein a moisture permeability of the layer including the chitin group substance and the synthetic resin is 3,000 $g/m^2/24$hours or more.

10. A fabric according to claim 9, wherein a layer including the chitin group substance and the synthetic resin is provided with a plurality of through-pores, whereby the moisture permeability of the layer becomes 3,000 $g/m^2/24$ hours or more.

11. A fabric according to claim 9, wherein a hydrophilic substance is included in the synthetic resin of the layer including the chitin group substance, whereby the moisture permeability of the layer becomes 3,000 $g/m^2/24$ hours.

12. A fabric according to claim 9, wherein a synthetic resin used in the layer including the chitin group substance and the synthetic resin is a copolymer of a hydrophobic monomer and a hydrophilic monomer, whereby the moisture permeability of the layer becomes 3,000 $g/m^2$/hours or more.

13. A fabric according to claim 1, wherein said synthetic resin is crosslinked by a crosslinker.

14. A fabric according to claim 13, wherein said cross linker is at least one selected from an epoxy compound, an isocyanate compound, a polyol and a bisacrylicamide compound.

* * * * *